US006116944A

United States Patent [19]

Tseng

[11] Patent Number: 6,116,944

[45] Date of Patent: Sep. 12, 2000

[54] ORNAMENTAL BULB SOCKET

[76] Inventor: Jeou-Nan Tseng, No. 539, Sec. 4, Chunghua Rd., Hsinchu, Taiwan

[21] Appl. No.: 09/351,499

[22] Filed: Jul. 12, 1999

[51] Int. Cl.[7] ..... H01R 4/24

[52] U.S. Cl. ..... 439/419; 419/340

[58] Field of Search ..... 439/419, 414, 439/340, 336, 356

[56] References Cited

U.S. PATENT DOCUMENTS

| | | | |
|---|---|---|---|
| 5,531,609 | 7/1996 | Cheng et al. | 439/419 |
| 5,702,268 | 12/1997 | Lien et al. | 439/419 |
| 5,807,134 | 9/1998 | Hara | 439/419 |
| 5,954,425 | 9/1999 | Lin | 439/419 |

*Primary Examiner*—Paula Bradley
*Assistant Examiner*—Tho D. Ta
*Attorney, Agent, or Firm*—Holland & Hart LLP

[57] ABSTRACT

The present invention relates to an ornamental bulb socket comprising a body, which defines an inner threaded socket for a bulb and a channel on the bottom thereof, and a bottom cap covering the bottom of the body. Two metal plates are provided in the socket, each one forms a square lug plate with a lower tip and integrally forms a contact plate thereon. A first elbowed metal plate has the lug plate inserted through a first hole defined in bottom of the body and the arch shaped contact plate supported on a part of the bottom of the body with its free end secured in a first fixing groove in the bottom of the body parallel to the first hole. The part of the body's bottom supporting the arched contact plate is formed in an arch shape to provide a flexibility to prevent the contact plate from deforming. A second metal plate has the contact plate twisted perpendicular to the lug plate and inserted through a second T-shaped hole defined in the bottom of the channel. One side of the contact plate of the second metal plate is secured in an second fixing groove defined in the sidewall of the socket hole of the body adjacent to the second hole, and the whole opposite side of the contact plate contacts the bulb.

8 Claims, 9 Drawing Sheets

ORNAMENTAL BULB SOCKET

FIELD OF THE INVENTION

The present invention relates to an ornamental bulb socket, particularly to an ornamental bulb socket with a decreased fabrication cost.

DESCRIPTION OF RELATED ART

As shown in FIG. 7, a conventional ornamental bulb socket comprises a body (60) and a bottom cap (70) covering the bottom of the body (60). The body (60) defines a socket (not numbered) with threads (602) formed on the inner wall of the socket for screwing a bulb therein, and a channel (66) radially defined in the bottom thereof for receiving a wire (40).

As shown in FIGS. 8, 9 and 10, a first and a second metal plate (80, 82) are provided in the body (60). Each of the first and the second metal plates (80, 82) have a square-shaped lug (802, 822), a sharp tip (804, 824) extending downward from the lug (802, 822) and a contact plate (806, 826) integrally formed on top of the lug (802, 822). Multiple contact points (828) are formed on the second metal plate (82). The metal plates (802, 822) are respectively inserted through one of holes (62, 64) defined in the bottom of the channel (66), then the tip ends (804, 824) are able to pierce through the insulation of the wire (40) to contact with the electrical core of the wire (40).

Referring to FIG. 8, the contact plate (806) is supported by a boss (624) on the bottom of the socket, and the free end is secured into a horizontal groove (622) parallel to the first hole (62). The contact plate (826) of the second metal plate (82) is securely set into a vertical groove (604) defined in the inner side wall of the body (60) adjacent to the second hole (64).

The bottom cap (70) integrally forms two fastening pieces (72) corresponding to two fastening holes (67) defined in the bottom of the body (60). The bottom cap (70) covers the bottom of the body (60) with the fastening pieces (72) respectively set into the fastening holes (67) to clamp the wire (40) in the channel (66).

However the defects of the above described conventional bulb socket are that:

1 The vertical groove (604) must increase the fabrication cost of molding;

2 Because the contact plate (826) set in the vertical groove (604) only contacts the bulb at the contact points (828), it is very possible to cause a contact fault;

3 As the contact plate (806) is supported by the boss (624), the contact plate (806) does not have the flexibility to prevent itself from deforming after repeated pressing by contact with the bulb's tip, whereby the contact plate (806) may lose contact with bulb;

4 A scupper (65) is normally formed at the bottom of the body (60), however when the bulb is screwed into the bulb socket, water remaining in the socket hole will not drain out the scupper (65) because of the vacuum in the socket blocked by the bulb and the bottom cap (70);

5 The bottom of the body (60) may be broken by the fastening pieces (72) of the bottom cap (70) in assembling in the case of an over tension.

SUMMARY OF THE INVENTION

The principal object of the present invention is to provide an ornamental bulb socket comprising a body and a bottom cap on the bottom of the body. The body defines an inner threaded socket hole for a bulb and a radial cross channel on the bottom to receive a wire. Two metal plates are provided in the socket, each one forms a square lug plate with a lower tip and integrally forms a contact plate thereon. The lug plates are respectively inserted through a hole and secured into a fixing groove with the tip puncturing the wire's insulation and contacting with one of the pair of wires.

Another object of the present invention is to provide a bulb socket, wherein the first metal plate is elbowed with the contact plate formed in an arch shape, the lug plate of the first metal plate is inserted through a first hole defined in bottom of the channel, and the arch contact plate is supported on an arch shaped part of the socket's bottom with the free end secured in a first fixing groove parallel to the first hole, whereby it provides the flexibility to prevent the arch contact plate from deforming under repeated contacting with the bulb's tip, in such a way the useful life of the bulb socket is increased and the possibility of a contact fault is decreased.

Another object of the present invention is to provide a bulb socket, wherein the contact plate of the second metal plate is twisted perpendicular the lug plate and inserted through a second T-shaped hole defined in the body's bottom, then has one side thereof secured into a second fixing groove defined in the side-wall of the socket adjacent to the second hole and the opposite side contacting the bulb by a whole side of the surface, whereby it decreases the possibility of a contact fault between the second metal plate and the bulb.

Another object of the present invention is to provide a bulb socket, wherein the body defines an axial canal in the side wall of the socket hole extending from the bottom thereof to the opening thereof, thereby any water remaining in the socket is drained via scuppers defined in the bottom of the body and the bottom cap;

Another object of the present invention is to provide a bulb socket, wherein the bottom cap integrally forms a lug there around to enclose the bottom of the body therein in order to prevent the bottom of the body from breaking under an over tension situation.

The detailed features of the present invention will be apparent in the detailed description with appropriate reference to the accompanying drawings.

DETAILED DESCRIPTION OF PREFERRED EMBODIMENT

Figure 1:
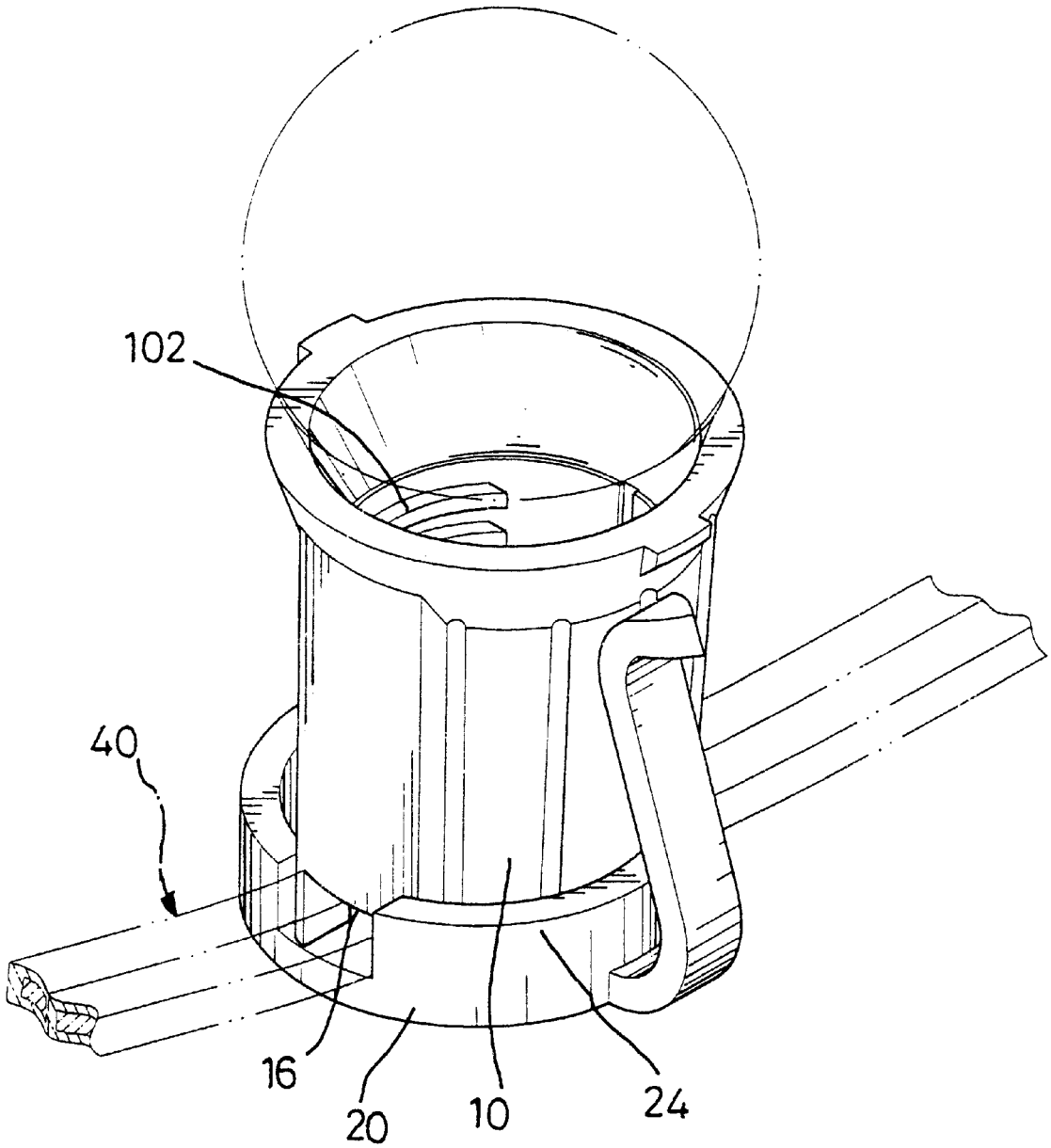
FIG. 1 is a perspective view of an ornamental bulb socket in accordance with the present invention.

As shown in FIG. 1, an ornamental bulb socket in accordance with the present invention comprises a body (10) and a bottom cap (20) covering the bottom of the body (10). The body (10) defines a socket with an inner thread (102) formed therein for screwing a bulb therein, and further defines a radial cross channel (16) in the bottom thereof to receive a wire (40).

Figure 2:
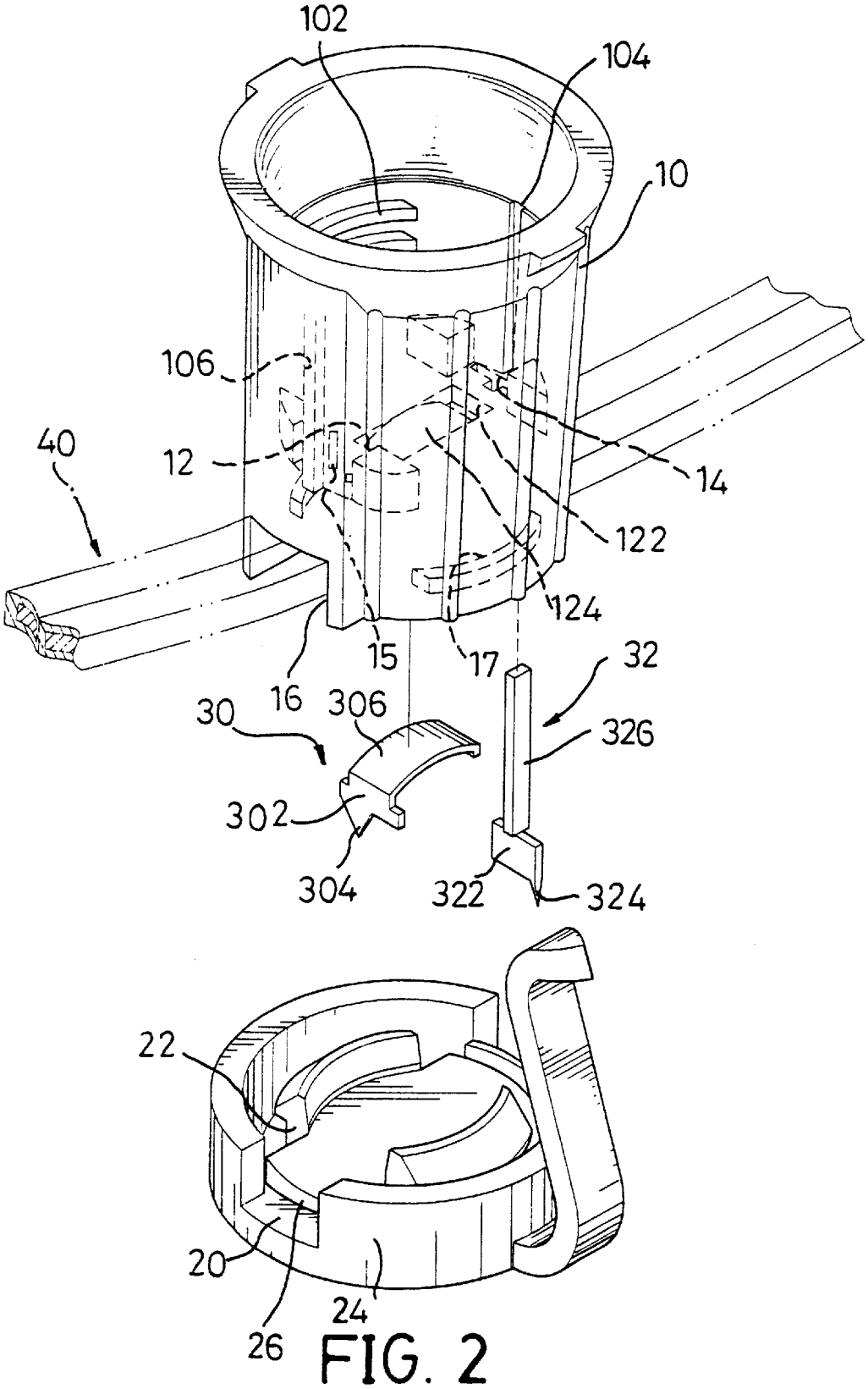
FIG. 2 is an exploded view of the ornamental bulb socket in FIG. 1.
Figure 3:
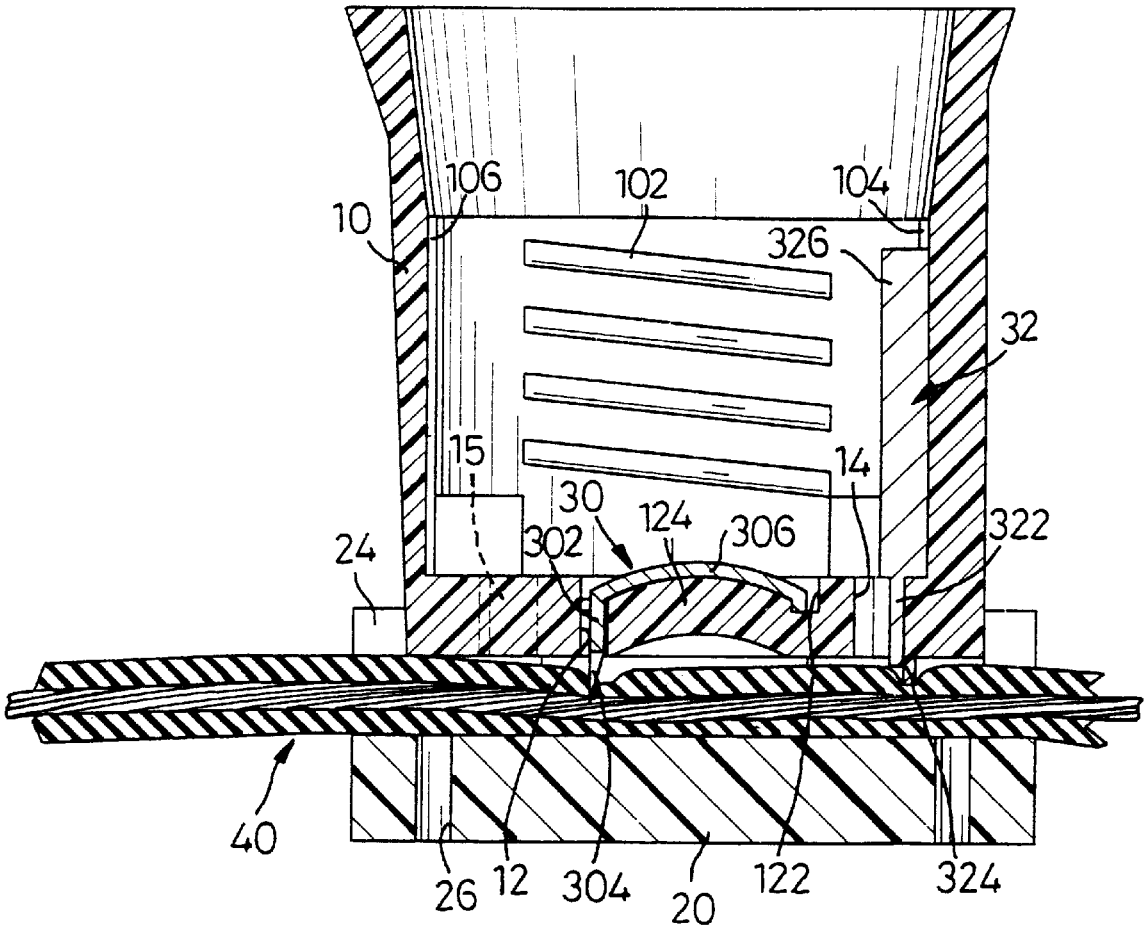
FIG. 3 is a side cross sectional plan view of the ornamental bulb socket FIG. 1.
Figure 10:
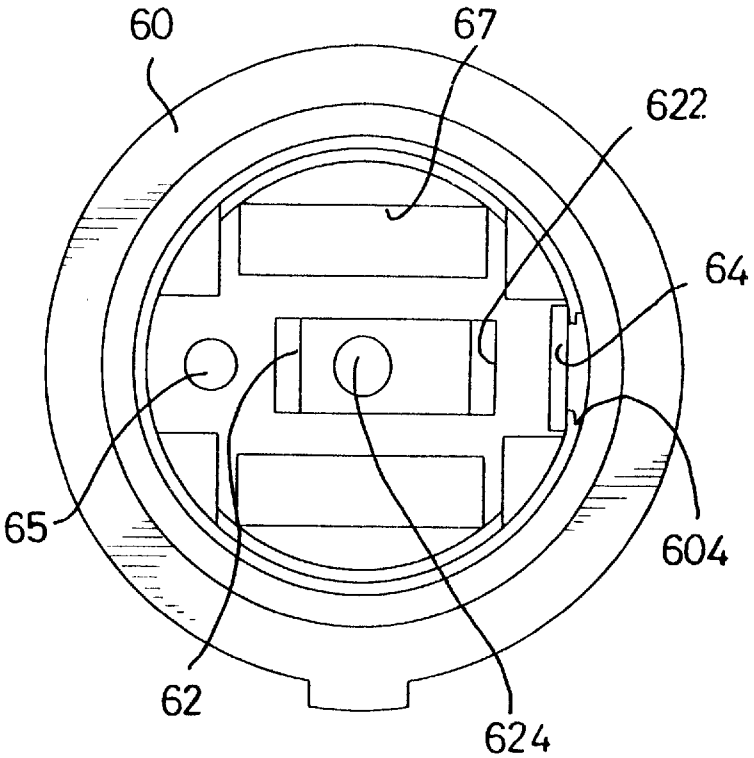
FIG. 10 PRIOR ART
FIG. 10 is a top view of the conventional ornamental bulb socket.
Figure 4:
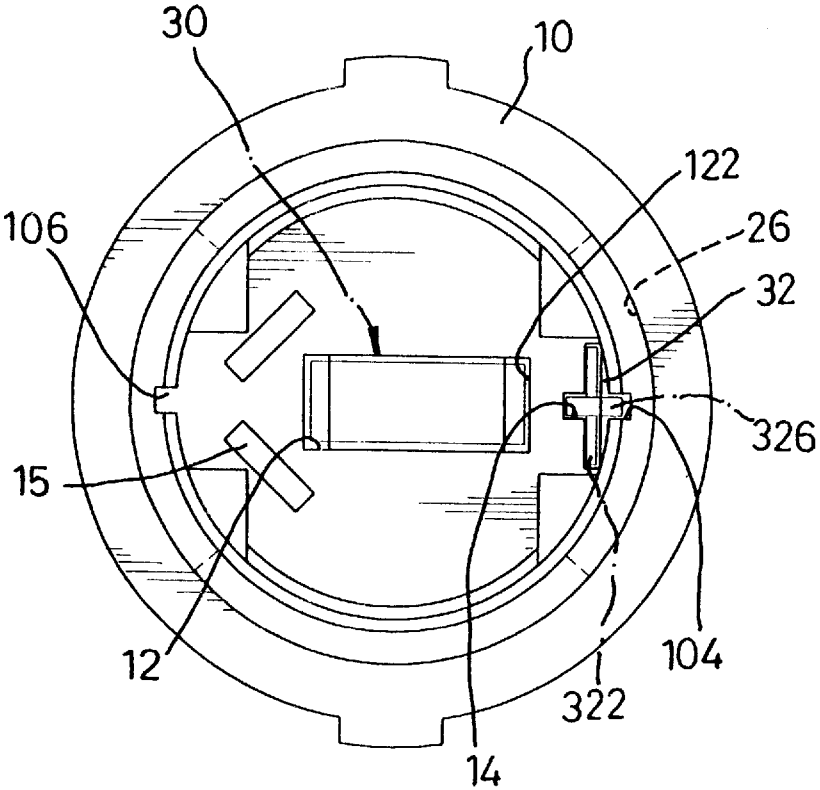
FIG. 4 is a top view of the ornamental bulb socket in FIG. 1.

As shown in FIGS. 2 and 3, two metal plates (30, 32) are provided in the socket of the body (10). Each metal plate (30, 32) forms a square lug plate (302, 322) with a lower tip (304, 324) and integrally forms a contact plate (306, 326) thereon. The lug plates (302, 322) are respectively inserted through a hole (12, 14) defined in the bottom of the body (10) with its tips (304, 324) inserted through the wire's insulation and contacting with one of the pair of wires (40).

The first metal plate (30) is elbowed and the contact plate (306) is formed in an arch shape. As best seen in FIG. 3, the first metal plate (30) has the lug plate (302) inserted through the first hole (12) and the contact plate (306) supported on an arch-shaped part (124) of the bottom of the body (10) with the free end thereof secured in a first fixing groove (122) defined in the bottom of the body (10) parallel to the first hole (12). The contact plate (306) supported on the arch-shaped part (124) is provided with a flexibility to prevent the contact plate (306) from causing a contact fault resulting from the deformation of the contact plate (306) deforming from repeated pressing of the bulb's tip on the contact plate (306).

The second metal plate (32) is cut at the junction between the contact plate (326) and the lug plate (322) so that the contact plate (326) can be twisted perpendicular to the lug plate (322). The second hole (14) is T-shaped adjacent to a second fixing groove (104) defined in the sidewall of the socket of the body (10). The contact plate (326) is inserted from the second T-shaped hole (14) with one side thereof secured in the second fixing groove (104) and the whole opposite side in contact with the bulb. Therefore contact faults between the second metal plate (32) and the bulb are decreased.

The bottom cap (20) integrally forms two fastening pieces (22) corresponding to two fastening holes (17) defined in the inner sidewall of the body (10), and further forms a lug (24) there around. When the bottom cap (20) covers the bottom of the body (10) with the fastening pieces (22) set into the fastening holes (17), the lug (24) encloses the bottom of the body (10) to keep it from breaking away.

Moreover, the body (10) defines two scuppers (15) on the bottom thereof, and further defines an axial canal (106) in the sidewall extending from the bottom of the body to the opening of the socket. The bottom cap (20) correspondingly defines a scupper (26). In such a way, the air in the socket hole communicates to the open air via the canal (106), and any water remaining in the socket drains through the scuppers (15, 26).

Figure 5:
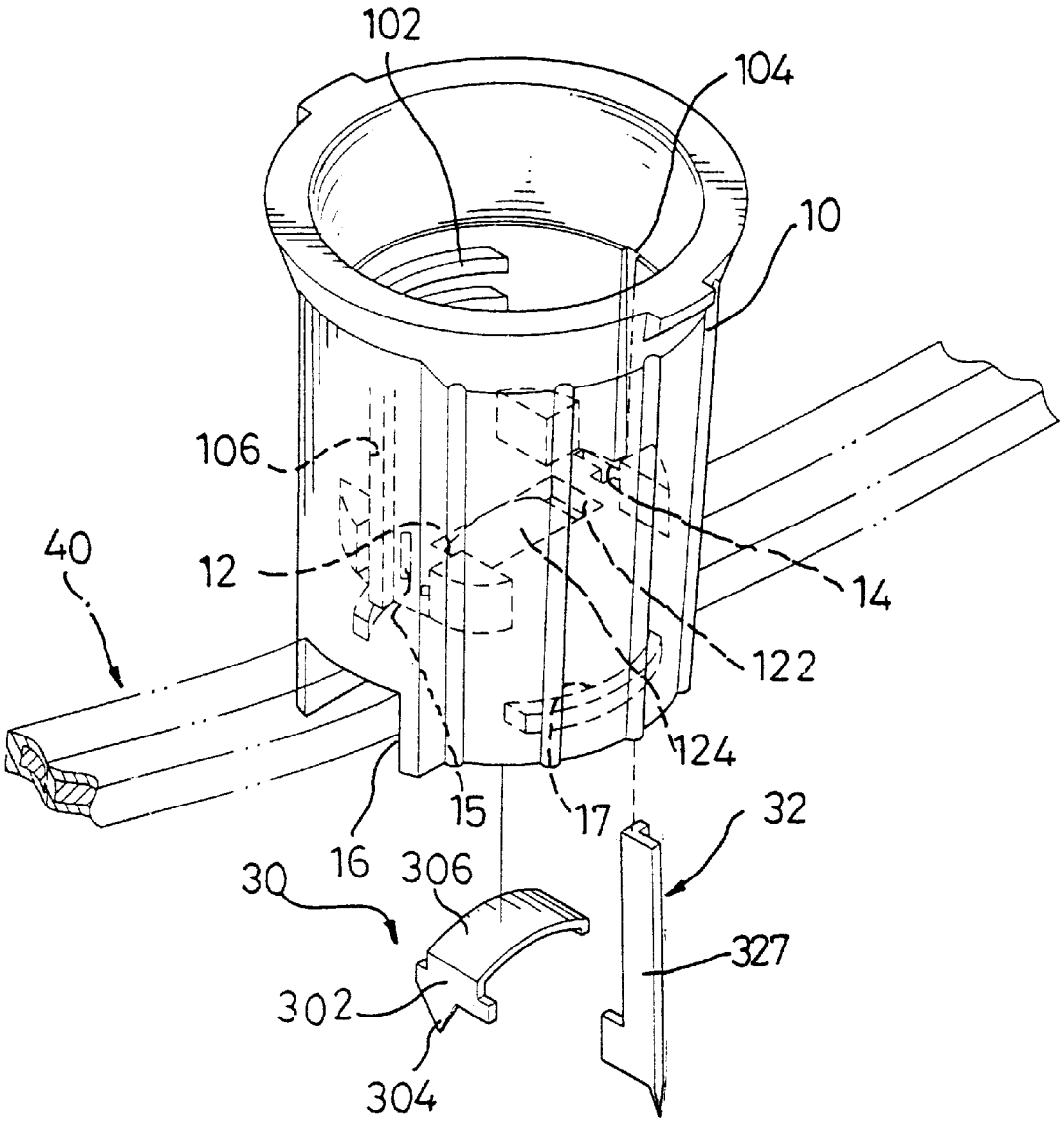
FIG. 5 is an exploded perspective view of an ornamental bulb socket in accordance with another embodiment of the present invention.
Figure 5:
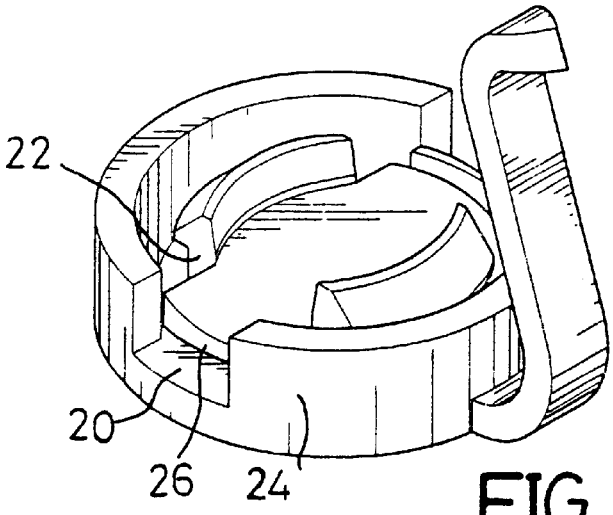
Figure 6:
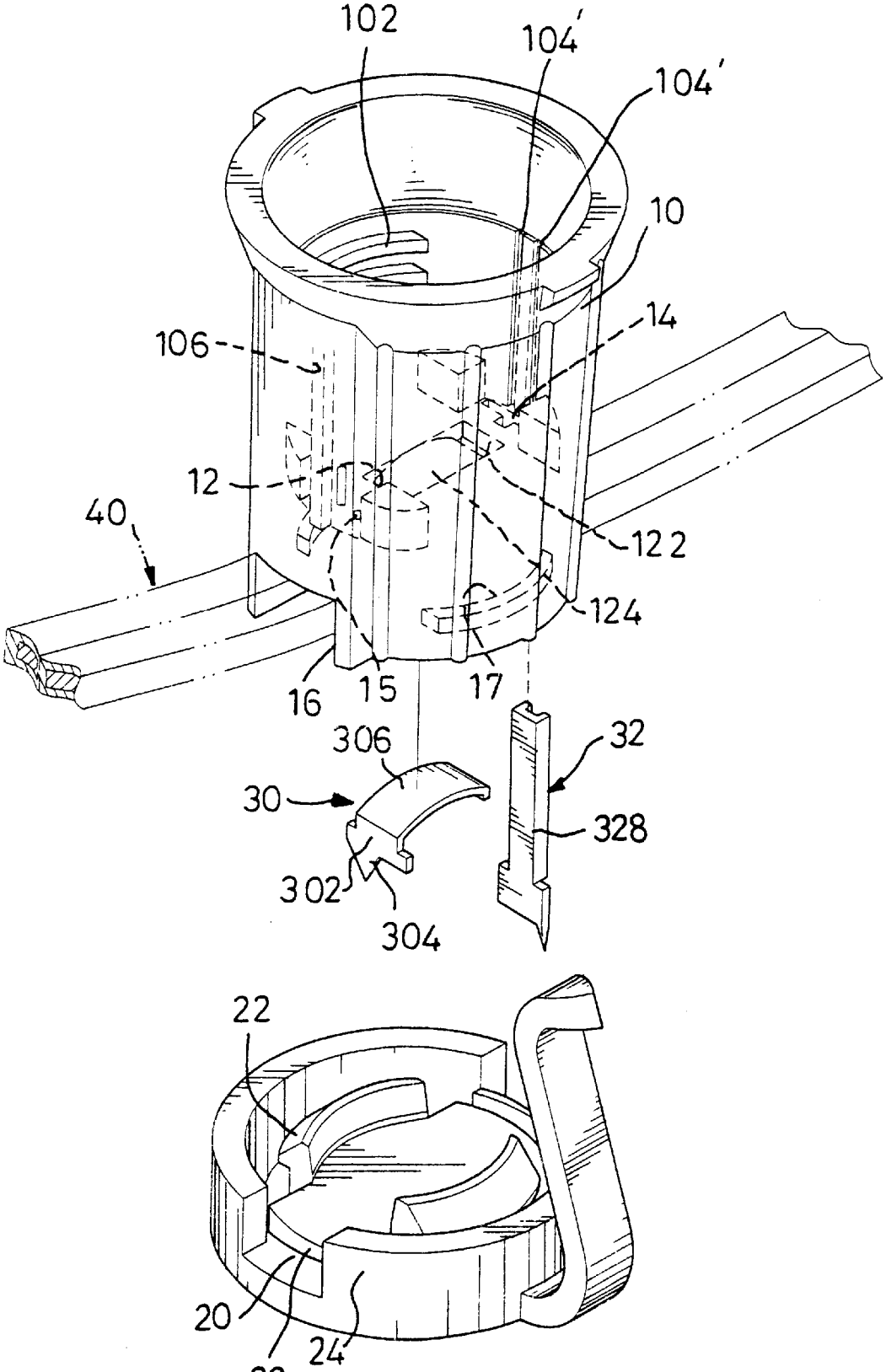
FIG. 6 is a perspective view of an ornamental bulb socket of yet another embodiment in accordance with the present invention.
Figure 7:
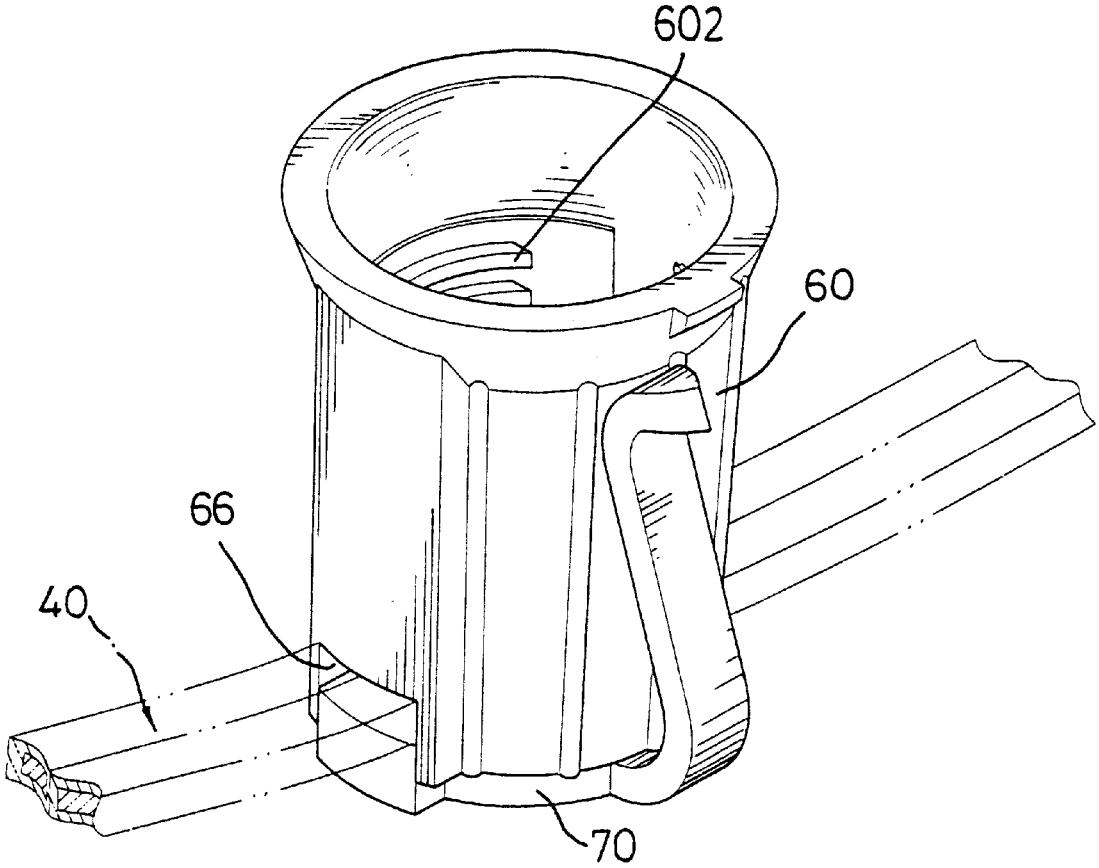
FIG. 7 PRIOR ART
FIG. 7 is a perspective view of a conventional ornamental bulb socket.
Figure 8:
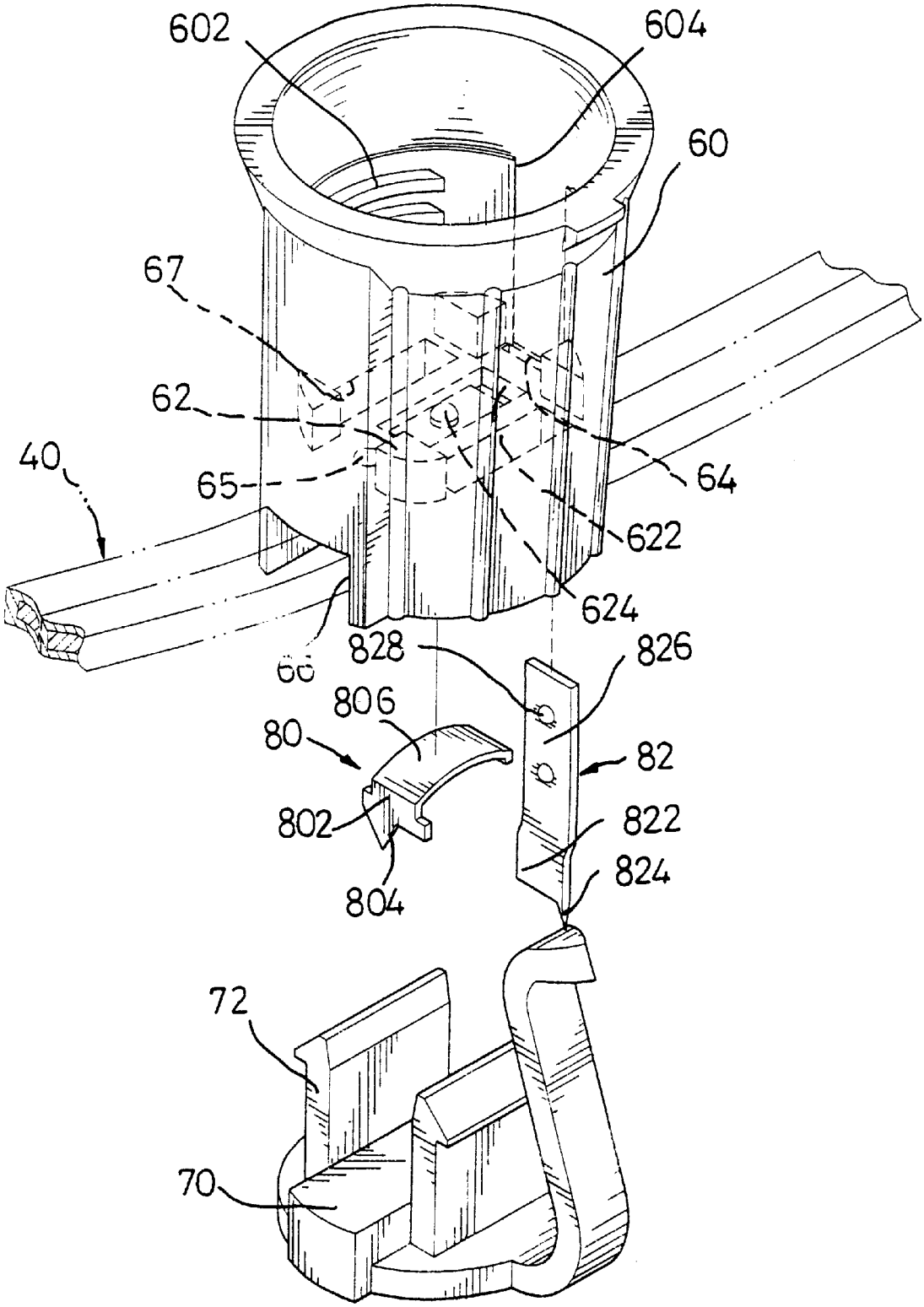
FIG. 8 PRIOR ART
FIG. 8 is an exploded perspective view of the conventional ornamental bulb socket.
Figure 9:
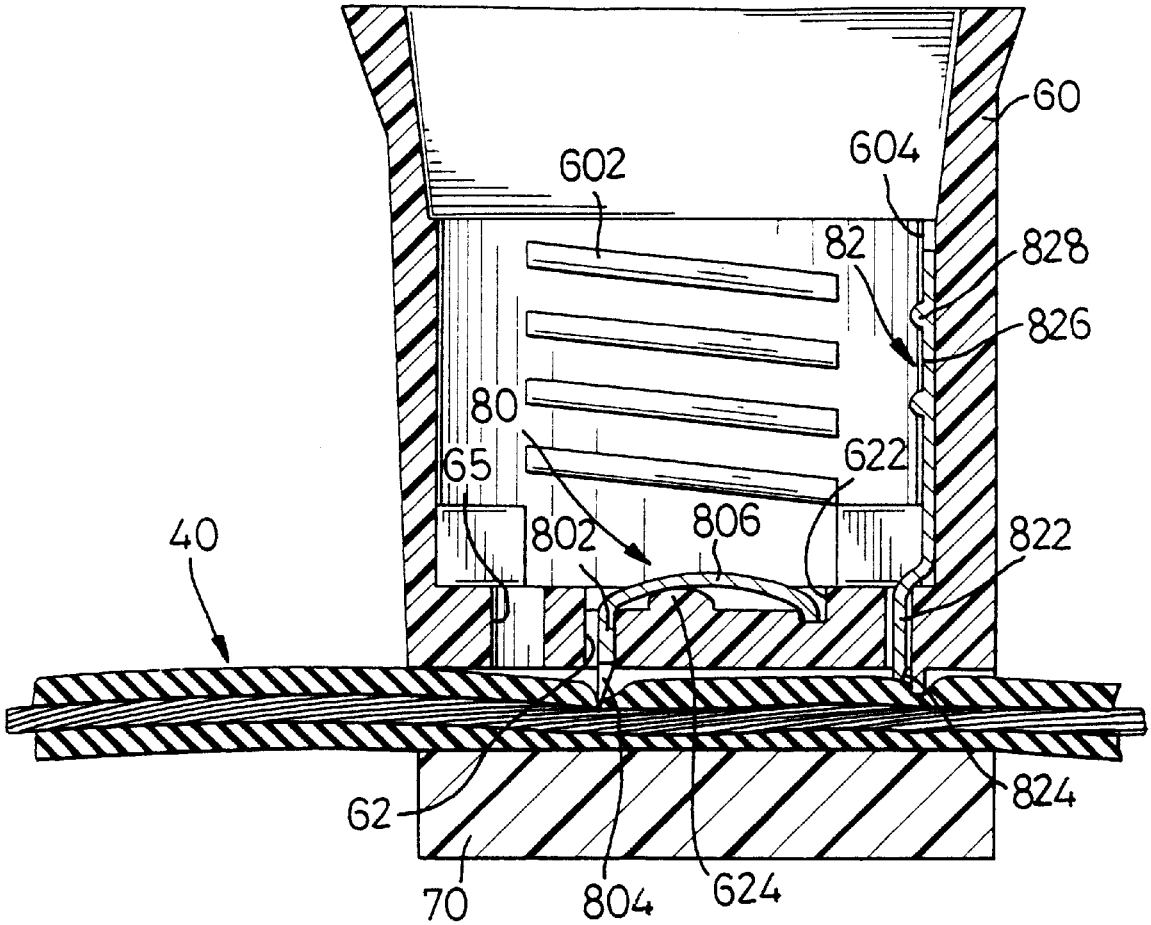
FIG. 9 PRIOR ART
FIG. 9 is a side cross sectional view of the conventional ornamental bulb socket.

As shown in FIG. 5, a second embodiment of the present invention is applicable, wherein the contact plate (327) of the second metal plate (32) is L-shaped with its one elbowed edge perpendicular to the lug of the second metal plate and secured into the second fixing groove (104) and contacts the bulb on a plan of the surface. As shown in FIG. 6, a third embodiment of the present invention is also applicable, wherein the contact plate (328) of the second metal plate (32) is C-shaped with its bilateral elbowed edges secured in two corresponding fixing grooves (104') and contacts the bulb on a plan of the surface.

What is claimed is:

1. An ornamental bulb socket comprising:

a body, which defines a socket with a thread formed therein for screwing a bulb therein, and further defines a radial cross channel in the bottom thereof for receiving a wire;

a bottom cap courting the bottom of the body;

a first metal plate provided in the socket of the body, wherein the first metal plate forms a first square lug plate with a lower piercing tip, and a first contact plate, the first square lug plate being inserted through a first hole defined in the bottom of the body, and the first contact plate being supported on a part of the body's bottom, the first contact plate formed in an arch shape and having an end extending from the first square lug plate, and an opposed free end thereof secured in a first fixing groove defined in the bottom of the body parallel to the first hole; and a second metal plate provided in the socket of the body, wherein the second metal plate forms a second square lug plate with a lower piercing tip, and a second contact plate extending from the second square lug plate, the second square lug plate being inserted through a second hole defined in the bottom of the body, wherein the second hole is substantially T-shaped, a portion of the second contact plate twiste, perpendicular to the second square lug plate and then one side of the second contact plate being secured in a second fixing groove defined in the sidewall of the socket adjacent to the second T-shaped hole.

2. An ornamental bulb socket as claimed in claim 1, wherein the part of the bottom of the body supporting the first contact plate forms an arch shape corresponding to the arch shape of the first contact plate.

3. An ornamental bulb socket as claimed in claim 1, wherein the bottom of body and the bottom cap respectively define a plurality of scuppers therein, and an axial canal is defined in the side wall of the socket hole extending from the bottom of body to the opening of the socket.

4. An ornamental bulb socket as claimed in claim 1, wherein the bottom cap integrally forms a lug there around for enclosing the bottom of the body.

5. An ornamental bulb socket as claimed in claim 1, wherein the bottom cap integrally forms two fastening pieces corresponding to two fastening holes defined in the inner sidewall of the bottom of the body.

6. An ornamental bulb socket as claimed in claim 1, wherein the second contact plate is a straight piece perpendicular to the second square lug plate.

7. An ornamental bulb socket as claimed in claim 1, wherein the contact plate of the second metal plate is an L-shaped piece with one elbowed edge perpendicular to the lug plate of the second metal plate and secured in the corresponding second fixing groove.

8. An ornamental bulb socket as claimed in claim 1, wherein the contact plate of the second metal plate is an C-shaped piece with two elbowed edges perpendicular to the lug plate of the second metal plate and secured in two corresponding fixing grooves defined in the sidewall of the socket of the body.

* * * * *